US007328583B2

(12) United States Patent
Hillman et al.

(10) Patent No.: US 7,328,583 B2
(45) Date of Patent: Feb. 12, 2008

(54) THERMALLY STABLE CONTAINMENT DEVICE AND METHODS

(75) Inventors: Arnold C. Hillman, Prior Lake, MN (US); Preston Williams, Minneapolis, MN (US)

(73) Assignee: Entropy Solutions, Inc., Minneapolis, MN (US)

( * ) Notice: Subject to any disclaimer, the term of this patent is extended or adjusted under 35 U.S.C. 154(b) by 553 days.

(21) Appl. No.: 11/021,457

(22) Filed: Dec. 22, 2004

(65) Prior Publication Data

US 2005/0150244 A1 Jul. 14, 2005

Related U.S. Application Data

(60) Provisional application No. 60/535,844, filed on Jan. 12, 2004.

(51) Int. Cl.
*B65B 63/08* (2006.01)
*F25D 3/08* (2006.01)

(52) U.S. Cl. ..... 62/60; 62/371; 62/457.2

(58) Field of Classification Search ..... 62/60, 62/371, 372, 440, 447, 451, 457.2, 465; 220/FOR. 127, 6

See application file for complete search history.

(56) References Cited

U.S. PATENT DOCUMENTS

| | | | | |
|---|---|---|---|---|
| 2,496,296 | A | 2/1950 | Lobl | |
| 3,096,902 | A * | 7/1963 | Schroeder | 405/55 |
| 3,931,424 | A * | 1/1976 | Helf et al. | 428/33 |
| 3,974,658 | A | 8/1976 | Starrett | |
| 4,145,895 | A | 3/1979 | Hjetstrand | |
| 4,319,629 | A | 3/1982 | Hotta | |
| 4,324,111 | A | 4/1982 | Edwards | |
| 4,446,705 | A * | 5/1984 | Loucks | 62/372 |
| 4,688,398 | A | 8/1987 | Baek | |
| 4,877,128 | A | 10/1989 | Strickland | |
| 4,892,226 | A | 1/1990 | Abtahi | |
| 4,923,077 | A | 5/1990 | Van Iperen | |
| 4,931,333 | A | 6/1990 | Henry | |
| 5,050,387 | A | 9/1991 | Bruce | |
| 5,088,301 | A | 2/1992 | Piepenbrink | |
| 5,157,888 | A * | 10/1992 | Lindquist | 52/745.01 |

(Continued)

FOREIGN PATENT DOCUMENTS

SU 428260 A * 12/1975

OTHER PUBLICATIONS

Minnesota Thermal Science "www.mnthermalscience.com 2004 Minnesota Thermal Science, LLC,".

(Continued)

*Primary Examiner*—Mohammad M. Ali
(74) *Attorney, Agent, or Firm*—Hahn Loeser + Parks LLP; Scott M. Oldham

(57) ABSTRACT

Thermal management systems and methods for manufacturing and using same are disclosed. Certain embodiments of the thermal management systems comprise configurations of corrugated, porous, or fibrous panels containing phase change materials within the interior of the panels. Liquid barrier layers are applied to the panels to at least keep the phase change materials from leaking out of the panels. The thermal management systems are passive systems which are able to maintain the temperature of pharmaceutical products placed within the systems within a predetermined temperature range over a predetermined period of time.

16 Claims, 11 Drawing Sheets

U.S. PATENT DOCUMENTS 5,219,504 A * 6/1993 Insley ..... 264/116
5,372,772 A * 12/1994 Bambacigno et al. ..... 264/278
5,435,142 A 7/1995 Silber
5,562,228 A 10/1996 Ericson
5,582,310 A * 12/1996 Del Zotto ..... 220/4.12
5,582,343 A 12/1996 Dalvey
5,758,513 A 6/1998 Smith
5,899,088 A 5/1999 Pardum
5,924,302 A 7/1999 Derifield
6,044,650 A * 4/2000 Cook et al. ..... 62/130
6,209,343 B1 4/2001 Owen
6,223,551 B1 5/2001 Mitchell
6,233,965 B1 5/2001 Choy
6,250,104 B1 6/2001 Bostic
6,266,972 B1 7/2001 Bostic
6,361,746 B1 3/2002 Wlodarski
6,405,556 B1 6/2002 Bucholz
6,453,682 B1 9/2002 Jennings et al.
6,457,323 B1 10/2002 Marotta
6,474,095 B1 11/2002 Chan
6,482,332 B1 11/2002 Malach
6,502,417 B2 1/2003 Gano, III
6,675,605 B2 * 1/2004 Douglas-Hamilton ..... 62/457.2
6,718,776 B2 4/2004 Wessling
2002/0050147 A1 5/2002 Mai et al.
2004/0079793 A1 4/2004 Mayer
2004/0079794 A1 4/2004 Mayer
2004/0231355 A1 11/2004 Mayer
2005/0256489 A1 * 11/2005 Sawyer et al. ..... 604/385.23
2006/0086741 A1 * 4/2006 Bacon et al. ..... 220/560.12

OTHER PUBLICATIONS

Journal of Heat Transfer, "Correlation of Melting Results For Bath Pure Substances and Impure Substances, E.M. Sparrow, et al., Aug. 1986, vol. 108/649,".

* cited by examiner

700

THERMALLY STABLE CONTAINMENT DEVICE AND METHODS

CROSS-REFERENCE TO RELATED APPLICATIONS/INCORPORATION BY REFERENCE

U.S. provisional application Ser. No. 60/535,844 filed on Jan. 12, 2004 is incorporated herein by reference in its entirety.

TECHNICAL FIELD

Certain embodiments of the present invention relate to the storage of temperature critical materials. More particularly, certain embodiments of the present invention relate to a passive thermal management system that maintains a predetermined temperature range for materials kept therein, such as pharmaceutical products, over a long period of time, without requiring a source of power.

BACKGROUND OF THE INVENTION

A variety of materials are desirably maintained at a predetermined temperature for various purposes. For example, sensitive materials such as pharmaceutical products are often stored and/or shipped in powered refrigeration units to keep the pharmaceutical products at a particular temperature that will keep the products from degrading and becoming unusable.

When pharmaceutical products are removed from a refrigeration storage unit and transported for use (e.g., to hospitals) they are often transported in an insulated container overnight which may or may not contain, for example, ice (i.e., frozen $H_2O$) or dry ice (i.e., frozen $CO_2$). However, such passive methods of transportation often allow the temperature of the products to vary more than desired and do not typically keep the temperature of the products within the desired range for a long enough period of time, thus requiring the shipping period to be shorter than may be desired (e.g., an overnight shipping period as opposed to a 72 hour desired shipping period).

As an alternative, a portable or semi-portable container with an internal active power and temperature regulation system to regulate the temperature within the container can be used. The active power system may include a battery and a refrigerant system, which adds to the complexity and weight of the container and may not have a desired level of reliability (e.g., the battery may discharge at a faster rate than desired). Another alternative is to use an external power source, such as a gasoline powered generator or external battery, which plugs into a temperature regulation system, in order to regulate the temperature within the container. This requires porting the external power source along with the container.

It is desired to have a lightweight, highly reliable, portable container that maintains the temperature of pharmaceutical products or other temperature sensitive materials over a relatively long or given period of time. For pharmaceutical products/materials for example, it is desired to maintain thermal stability to allow the material to ultimately be administered to patients many hours or days after they were first placed into the container.

Further limitations and disadvantages of conventional, traditional, and prior proposed approaches will become apparent to one of skill in the art, through comparison of such systems and methods with the present invention as set forth in the remainder of the present application with reference to the drawings.

BRIEF SUMMARY OF THE INVENTION

An embodiment of the present invention comprises a thermal management system. The thermal management system includes a plurality of corrugated panels connected together to form a container. The system further includes a phase change material occupying voids within an interior of the plurality of corrugated panels, and a liquid barrier material deposited on or integrated into at least one surface of each of the plurality of corrugated panels to at least prevent the phase change material from leaking out of the interior of the plurality of corrugated panels.

Another embodiment of the present invention comprises a method of manufacturing a thermal management system. The method comprises depositing a liquid barrier material onto at least one surface of each of a plurality of corrugated panels and injecting a liquid-phase mixture of phase change material and trigger agent into a plurality of voids within the plurality of corrugated panels. The method further comprises sealing the mixture of phase change material and trigger agent within the plurality of corrugated panels and connecting the plurality of corrugated panels to form a container.

A further embodiment of the present invention comprises a method of using a thermal management system. The method comprises thermally preconditioning a container at a preconditioning temperature for a predefined period of time. The container is designed to include a plurality of corrugated panels connected together to form the container, a phase change material occupying voids within an interior of the plurality of corrugated panels, and a liquid barrier material deposited onto at least one surface of each of the plurality of corrugated panels to at least prevent the phase change material from leaking out of the interior of the plurality of corrugated panels. The method further includes opening the container, placing at least one pharmaceutical product or material into the container, and closing the container. The method also comprises shipping the container to a destination location during a predetermined time period such that a temperature of the at least one sample stays within a predetermined temperature range over the predetermined time period due to the design of the container.

Another embodiment of the present invention comprises a thermal management system. The thermal management system comprises a plurality of structurally porous panels connected together to form a container. A phase change material occupies voids within an interior of the plurality of structurally porous panels. The system further includes a liquid or fluid barrier material deposited onto at least one surface of each of the plurality of structurally porous panels to at least prevent the phase change material from leaking out of the interior of the plurality of structurally porous panels.

A still further embodiment of the present invention comprises a thermal management system. The thermal management system includes a plurality of fibrous-material panels connected together to form a container. The system further includes a phase change material absorbed into an interior of the plurality of fibrous-material panels. The system also includes a liquid barrier material deposited onto at least one surface of each of the plurality of fibrous-material panels to at least prevent the phase change material from leaking out of the interior of the plurality of fibrous-material panels.

The advantages and novel features of the present invention, as well as details of illustrated embodiments thereof, will be more fully understood from the following description and drawings.

DETAILED DESCRIPTION OF THE INVENTION

Figure 1:
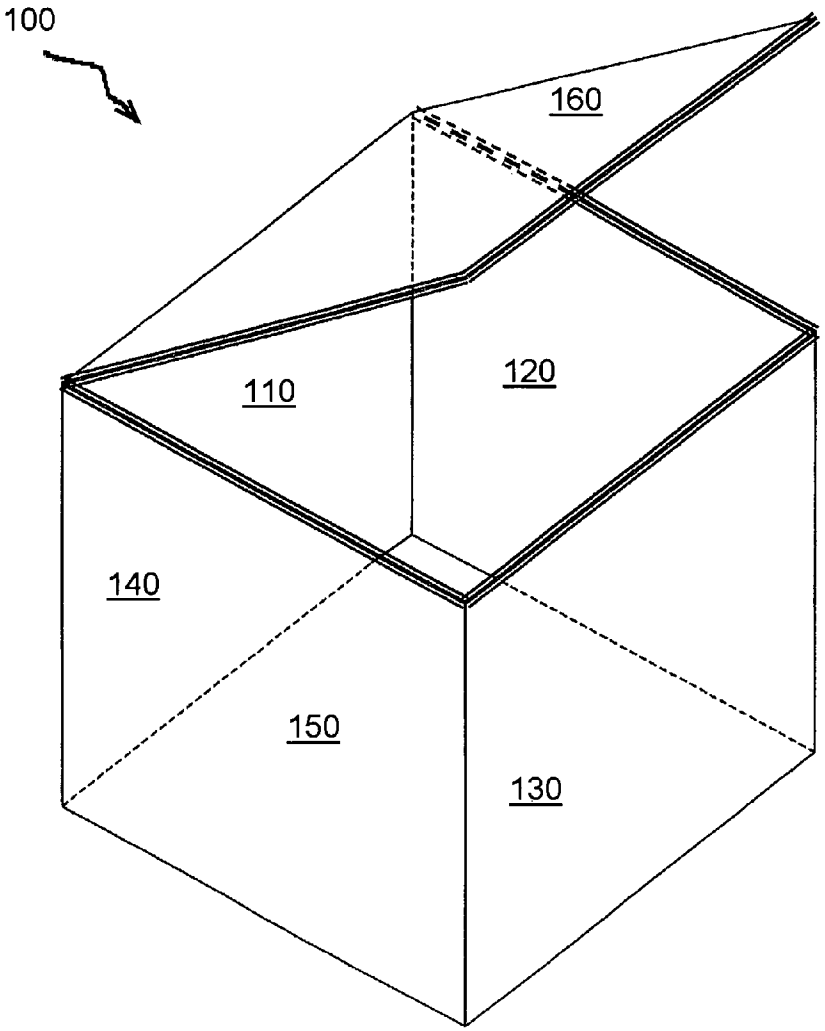
FIG. 1 is an exemplary illustration of a first embodiment of a passive thermal management system for transporting temperature sensitive materials, in accordance with various aspects of the present invention.

FIG. 1 is an exemplary illustration of a first embodiment of a passive thermal management system 100 for transporting temperature sensitive materials, in accordance with various aspects of the present invention. For example, human blood is typically stored at temperatures between 1° C. and 10° C. Refrigerated pharmaceuticals are typically stored between either 2° C. and 8° C. or 6° C. and 10° C. For temperature sensitive materials such as this, the materials many times simply cannot be subjected to temperature variation or fluctuation, and must be maintained within a very narrow temperature range. The passive thermal management system 100 is essentially a box-like container comprising five corrugated side panels 110-150 and a corrugated lid panel 160. Samples of materials such as, for example, pharmaceutical products to be held within a predetermined temperature range are place within the container 100. Other shapes of the thermal management system are possible as well, in accordance with alternative embodiments of the present invention. For example, a cylindrical shape may be preferred for certain applications. Other size and dimensional characteristics are also contemplated and within the scope of the invention, as the system 100 may be specifically configured to hold and store different products or materials requiring differing configurations.

Figure 2:
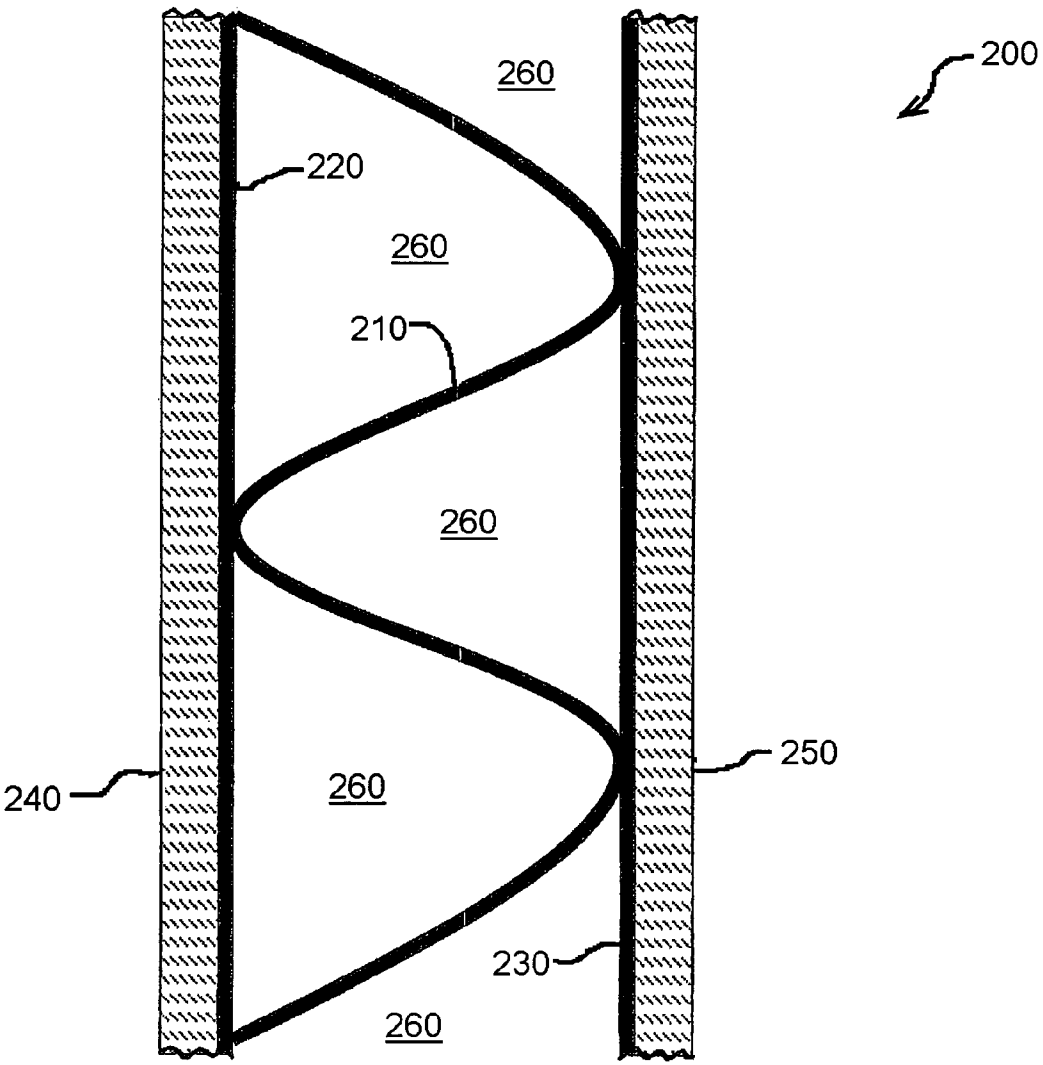
FIG. 2 is an exemplary illustration of an embodiment of a corrugated panel used to form a side of the passive thermal management system of FIG. 1, in accordance with various aspects of the present invention.

FIG. 2 is an exemplary illustration of an embodiment of a corrugated panel 200 used to form a side of the passive thermal management system 100 of FIG. 1, in accordance with various aspects of the present invention. All five-side panels 110-150 and the lid panel 160 are constructed in a similar manner. The corrugated panel 200 comprises a flute 210 acting as a corrugated support structure between two mediums 220 and 230. The outer surfaces of the mediums 220 and 230 are coated with layers of a liquid barrier material 240 and 250 respectively. The voids or gaps 260 formed by the flute 210 within the interior of the corrugated panel 200 are filled with a phase change material (PCM) in a liquid phase.

In accordance with an embodiment of the present invention, the flute 210 and mediums 220 and 230 comprise common cardboard material (i.e., paper) and form the basic structure of the panel 200. The flute 210 of the corrugated panel 200 provides lightweight, structural stability to the panel 200. There are at least five different standard size flutes that are used commercially in the cardboard container industry.

In accordance with an embodiment of the present invention, the PCM comprises a paraffin material, which melts and solidifies within a certain temperature range profile and, in doing so, is capable of storing or releasing energy. As a result, the PCM can be used to help maintain or regulate the temperature of materials within the thermal management system 100 (e.g., pharmaceutical products or blood). For example, a PCM may be designed to change phase (i.e., melt or solidify) in a range around approximately 4° C., which is an ideal temperature for storing bags of human blood. PCM paraffins having various temperature characteristics are available in the marketplace and are often used in the electronics industry. Other substances, such as eutectic salts, may be used as the PCM, in accordance with other embodiments of the present invention. Also, a trigger agent can be mixed with the PCM, and has the effect of stimulating the PCM to change phase within a desired temperature range, providing further control of the temperature stability provided thereby. The trigger agent may initiate solidification when a liquid exists at a temperature that is lower than the normal solidification temperature, wherein the liquid is in a supersaturated state. For some PCM materials, dependent on the phase change characteristics thereof, the temperature range in which the material melts and solidifies may be sufficient for maintaining a desired temperature range profile.

During the melting process, when the solid phase and the liquid phase are both present, further melting takes place at a constant temperature when the participating substance (e.g., PCM) is pure. Alternatively, if the participating substance is a mixture of two or more substances (e.g., two or more PCMs) melting takes place over a range of temperatures. In general, a pure substance is much more costly than a related impure substance. For example, pure paraffin may cost ten times as much as impure paraffin. For PCM's that are not pure, the melting and temperature stability characteristics of the material may be determined by correlation to pure substances, and may be used to reduce the cost of the material relative to pure substances.

The amount of heat needed to convert a kilogram of solid to a kilogram of liquid by means of melting is called the latent heat of melting. The magnitude of the latent heat of melting is the key to the effectiveness of melting as a heat-blocking process. The melting of a kilogram of ice absorbs about 330 kJ (kilojoules) of heat. To melt a kilogram of a typical paraffin, about 232 kJ are needed.

Although it would appear that ice would provide better heat-blocking effectiveness than would paraffin. However, ice melts to liquid water at 0° C., a temperature that could cause catastrophic damage to blood, certain tissues, and certain temperature sensitive pharmaceuticals. Therefore, the ice-to-water melting process cannot be used for the thermal protection of such materials.

The family of paraffins is very large, depending on the number of carbon atoms, which comprise each specific paraffin. Each specific paraffin melts at a different temperature. Consequently, if thermal protection in a specific temperature range is required, if there is a paraffin material that may change phase in that temperature range, either alone or in conjunction with a trigger agent. As an example, the system 100 according to the invention, may be designed to store pharmaceutical products within a specific temperature range around 8° C. For such an example, paraffins that may be suitable for use in the invention are produced by Honeywell International, Inc., under the trademark Astor. These materials exploit the solid-liquid phase change, and have sharp melting profiles to allow more precise and controlled energy release and absorption. These materials are also stable and inert, facilitating use in the container configuration of the invention. As an example, the Astor Astorphase 8X-B material has a melting point of 8° C., a thermal capacity of 191 kJ/kg, and a specific gravity of 0.87, and a sharp melting profile, making it useful for a system 100 according to the invention, which may be used for storage of certain pharmaceutical products.

If for a particular application, thermal protection at a given temperature is required and there is no paraffin that changes phase at that temperature, it is possible to mix two or more paraffins and arrive at the desired phase change temperature of the mixture. The use of paraffins as heat-blocking agents provides an unexpected dividend because the low thermal conductivity of liquid paraffins serves as a thermal insulator that slows the rate at which heat approaches the melting zone. Another advantage of paraffins is their relatively low cost.

The liquid barrier material layers 240 and 250 serve to contain the PCM material within the panel 200. That is, the liquid barrier material layers 240 and 250 prevent the PCM from leaking out of the interior of the panel 200. The liquid barrier material is typically coated or deposited onto the outer surfaces of the panel 200 and may include any of a number of materials that can prevent the migration of the PCM to the outside of the panel 200. Alternatively, the barrier material can be integrated into the material from which panel 200 is made. In general, the liquid barrier material may be used in a variety of places within and on the corrugated panels, as the design dictates. For example, the liquid barrier material may be used to coat the flute 210, in accordance with an embodiment of the present invention. A possible liquid barrier material construction suitable for use in the invention may be M-Guard materials produced by Liberty Paper, Inc.

Figure 3:
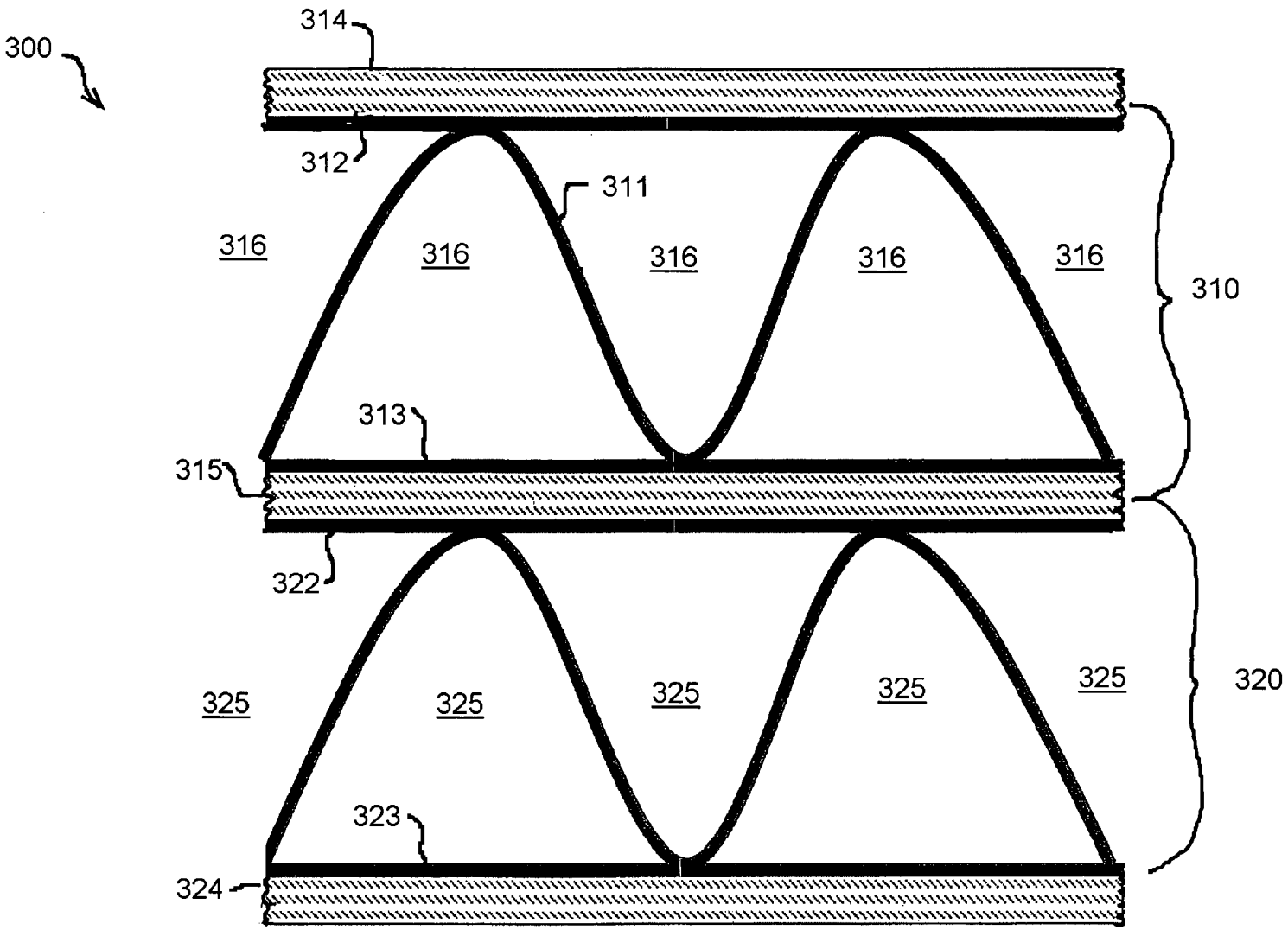
FIG. 3 is an exemplary illustration of an embodiment of a layered structure of corrugated panels used to form a side of the passive thermal management system of FIG. 1, in accordance with various aspects of the present invention.

FIG. 3 is an exemplary illustration of an embodiment of a layered structure of corrugated panels 300 used to form a side of the passive thermal management system 100 of FIG. 1, in accordance with various aspects of the present invention. The layered structure 300 comprises a first corrugated layer 310 stacked onto a second corrugated layer 320.

The first corrugated layer 310 includes a flute 311, mediums 312 and 313, and barrier layers 314 and 315. The first corrugated layer 310 also includes a plurality of gaps or voids 316, which are filled with PCM. The second corrugated layer 320 includes a flute 321, mediums 322 and 323, and barrier layers 315 and 324. Notice that, in this embodiment, the barrier layer 315 is shared between the first corrugated layer 310 and the second corrugated layer 320. The second corrugated layer 320 also includes a plurality of gaps or voids 325, which are filled with PCM.

In accordance with various embodiments of the present invention, more than two corrugated layers may be used to form a layered structure of corrugated panels for use in a thermal management system. In general, the design of each layer (thickness, PCM, trigger agent, barrier material, etc.) and the number of such layers determines the thermal performance of the panel and, therefore, of the overall resultant container (i.e., thermal management system). Numerical simulations and/or algorithms may be used to determine the design of the thermal management system for a desired thermal performance (i.e., maintaining a desired temperature range over a desired period of time). The algorithms may also take into account cost, allowing a designer to balance cost versus number of PCM layers and insulation layers, for example.

Figure 4B:
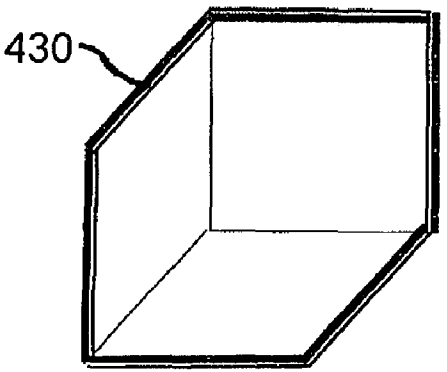
FIGS. 4A-4C are exemplary illustrations of embodiments of layered structures of corrugated panels used to thermally reinforce internal edges and corners of the thermal management system of FIG. 1, in accordance with various aspects of the present invention.
Figure 4C:
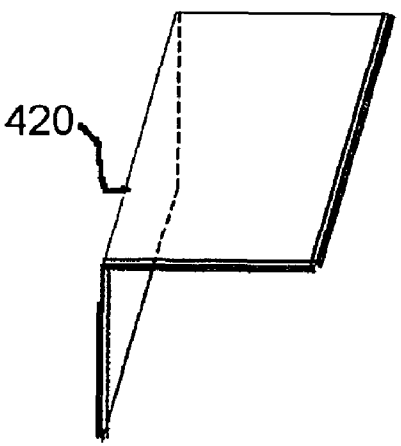
Figure 4A:
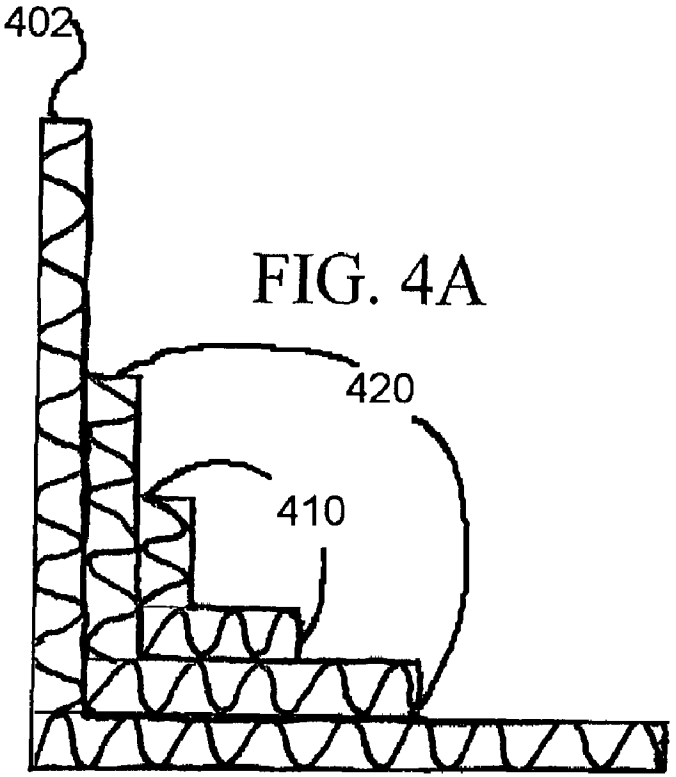

Numerical simulations have shown that thermal loss in such a thermal management system as container 100 is greatest at corners and edges of the container 100. FIGS. 4A-4C are exemplary illustrations of embodiments of layered structures of corrugated panels used to thermally reinforce internal edges and corners of the thermal management system 100 of FIG. 1, in accordance with various aspects of the present invention.

Referring to FIG. 4A, two additional corrugated layer configurations 410 and 420 are applied to an edge formed by corrugated layers 401 and 402. FIG. 4C illustrates a configuration of such an additional corrugated layer configuration 420. FIG. 4B illustrates a corrugated layer configuration 430 that may be used to thermally reinforce a corner of the container 100. Again, the thermal effectiveness of these edge and corner layer configurations depends on their design (i.e., thickness, PCM material, trigger agent, barrier material, etc.).

Figure 5:
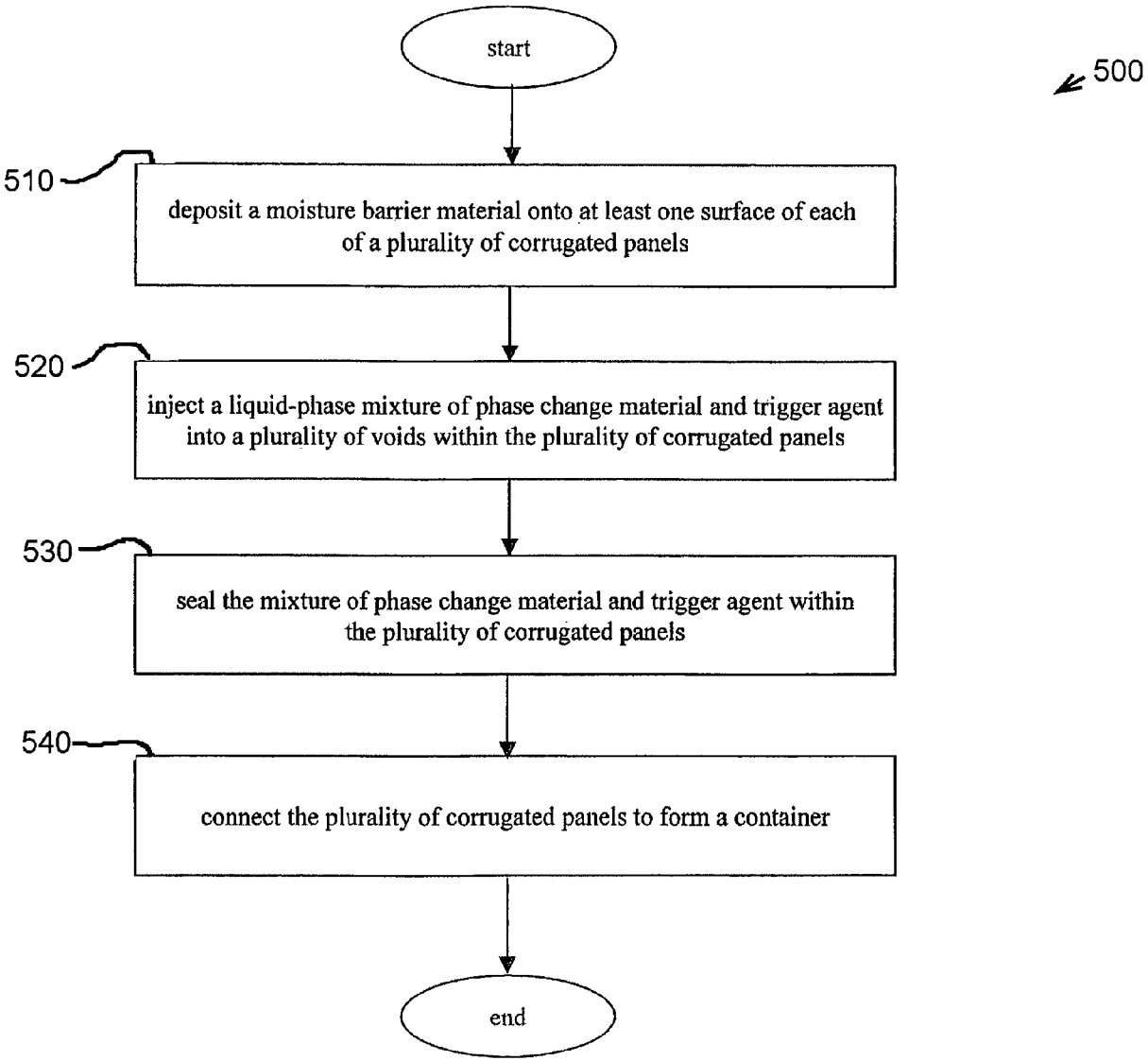
FIG. 5 is a flow chart of an embodiment of a method of manufacturing the thermal management system of FIG. 1, in accordance with various aspects of the present invention.

FIG. 5 is a flow chart of an embodiment of a method 500 of manufacturing the thermal management system 100 of FIG. 1, in accordance with various aspects of the present invention. In step 510, a liquid barrier material is deposited onto at least one surface of each of a plurality of corrugated panels. In step 520, a liquid-phase mixture of PCM and trigger agent is injected into a plurality of voids within the plurality of corrugated panels. In step 530, the mixture of PCM and trigger agent is sealed within the plurality of corrugated panels. In step 540, the pluralities of corrugated panels are connected to form a container (i.e. a thermal management system). Filling the panels with the PCM mixture is considered a secondary manufacturing process after making the corrugated material (e.g., cardboard). Such a method effectively turns a cardboard box into a thermal management system.

Referring to FIG. 1 in light of FIG. 5, the inner and outer surfaces of the corrugated panels 110-160 may be coated with a liquid barrier material to form an inner and outer layer of barrier material on each panel (see FIG. 2). The mixture of PCM and trigger agent may be injected into an edge of each panel 110-160 using, for example, a PCM dispensing machine with a set of injection needles. In accordance with an embodiment of the present invention, the barrier material acts to wick the PCM mixture towards the barrier material. The barrier material does not degrade the physical integrity of the cardboard structure (i.e., mediums and flute and any glue used therein).

The mixture of PCM and trigger agent are sealed within the panels (i.e., the edges of each panel are sealed). For example, for a given panel having four edges, three of the edges may be sealed before injecting the mixture. Once the mixture is injected into the fourth edge, the fourth edge may be sealed. The edges of a panel may be sealed with the same barrier material used to coat the sides of the panels, or another sealing material may be used instead (e.g. a stable wax material). The panels 110-160 may then be connected to form the container 100. For example, glues may be used to connect the panels.

Alternatively, some or all of the panels 110-160 may be connected before injecting the mixture. For example, the panels 110-160 may initially be formed as one flat sheet, which is subsequently cut and folded to form the container configuration 100.

Figure 6:
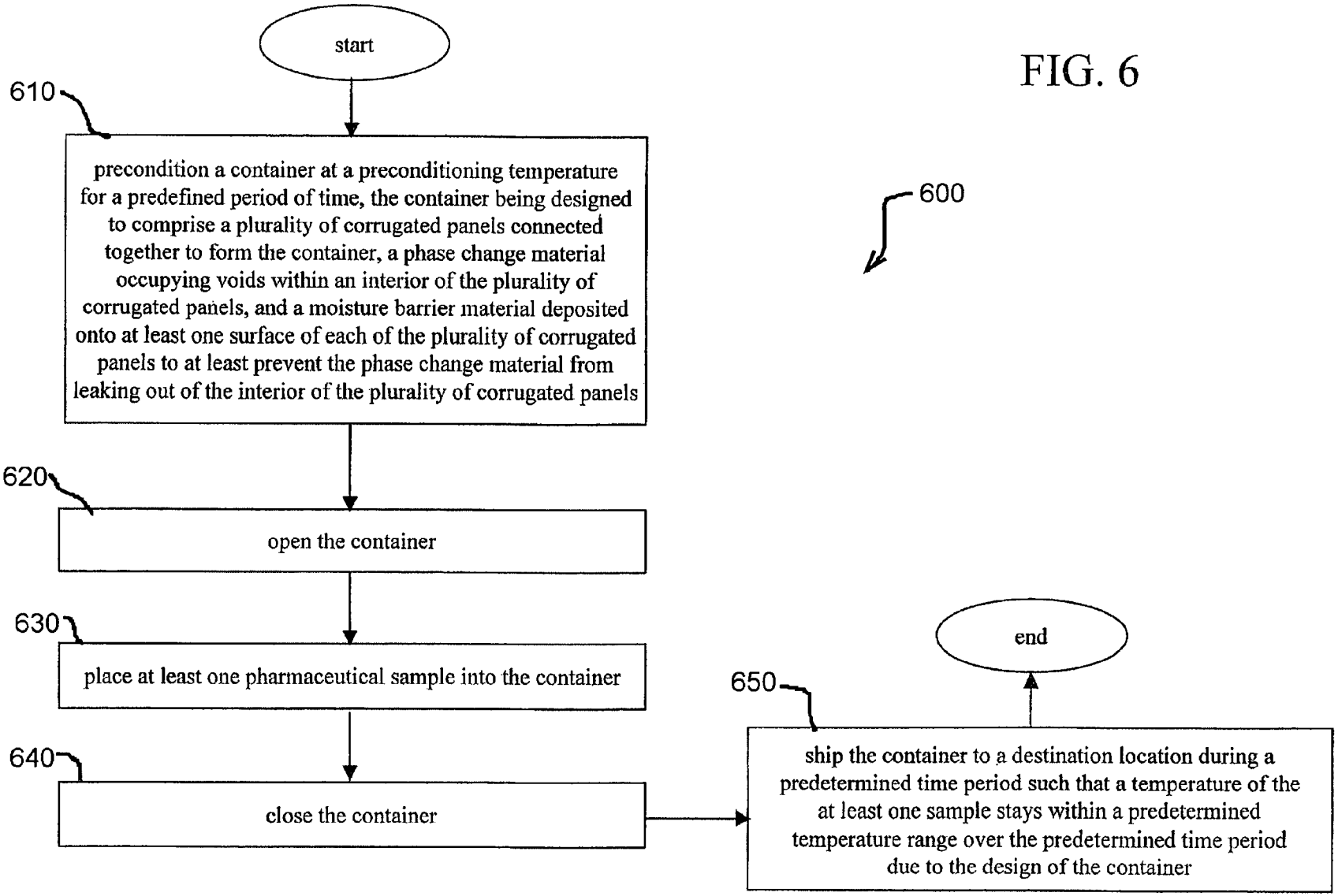
FIG. 6 is a flow chart of an embodiment of a method of using the thermal management system of FIG. 1, in accordance with various aspects of the present invention.

FIG. 6 is a flow chart of an embodiment of a method 600 of using the thermal management system 100 of FIG. 1, in accordance with various aspects of the present invention. In step 610, a container (i.e., thermal management system) is preconditioned at a preconditioning temperature for a predefined period of time. The container is designed to comprise a plurality of corrugated panels connected together to form a container, a phase change material occupying voids within an interior of the plurality of corrugated panels, and a liquid barrier material deposited onto at least one surface of each of the plurality of corrugated panels to at least prevent the phase change material from leaking out of the interior of the plurality of corrugated panels. In step 620, the container is opened (e.g., a lid of the container is opened). In step 630, at least one pharmaceutical sample is placed into the container. In step 640, the container is closed (e.g., a lid of the container is closed). In step 650, the container is shipped to a destination location during a predetermined time period such that a temperature of the at least one sample stays within a predetermined temperature range over the predetermined time period due to the design of the container.

For example, the container 100 may be preconditioned at a temperature of −20° C. for 6 hours in a freezer unit before placing vials of injectable pharmaceutical products into the container for shipping. The preconditioned container may keep the pharmaceutical products within a temperature range of, for example, 6° C. to 10° C. during a 72 hour shipping time period.

Figure 7:
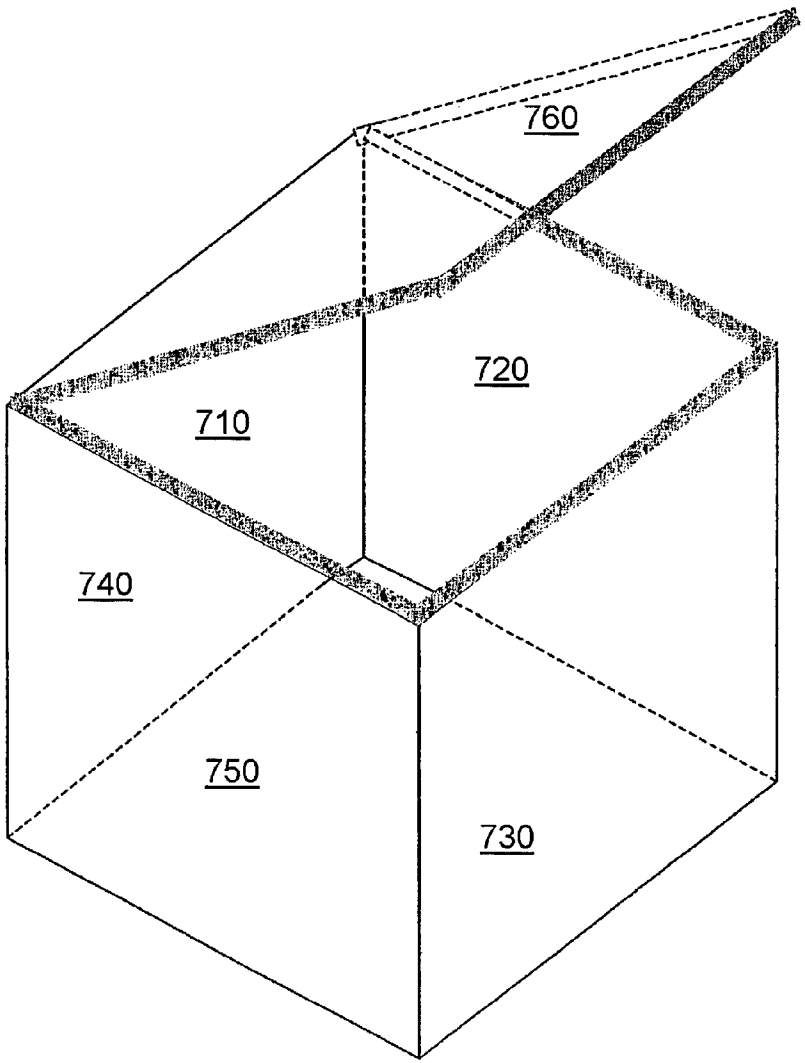
FIG. 7 is an exemplary illustration of a second embodiment of a passive thermal management system for transporting temperature sensitive materials, in accordance with various aspects of the present invention.

FIG. 7 is an exemplary illustration of a second embodiment of a passive thermal management system 700 for transporting temperature sensitive materials, in accordance with various aspects of the present invention. The passive thermal management system 700 is essentially a box-like container comprising five porous side panels 710-750 and a porous lid panel 760. Samples of materials, such as pharmaceutical products or blood, to be held within a predetermined temperature range are placed within the container 700.

Figure 8:
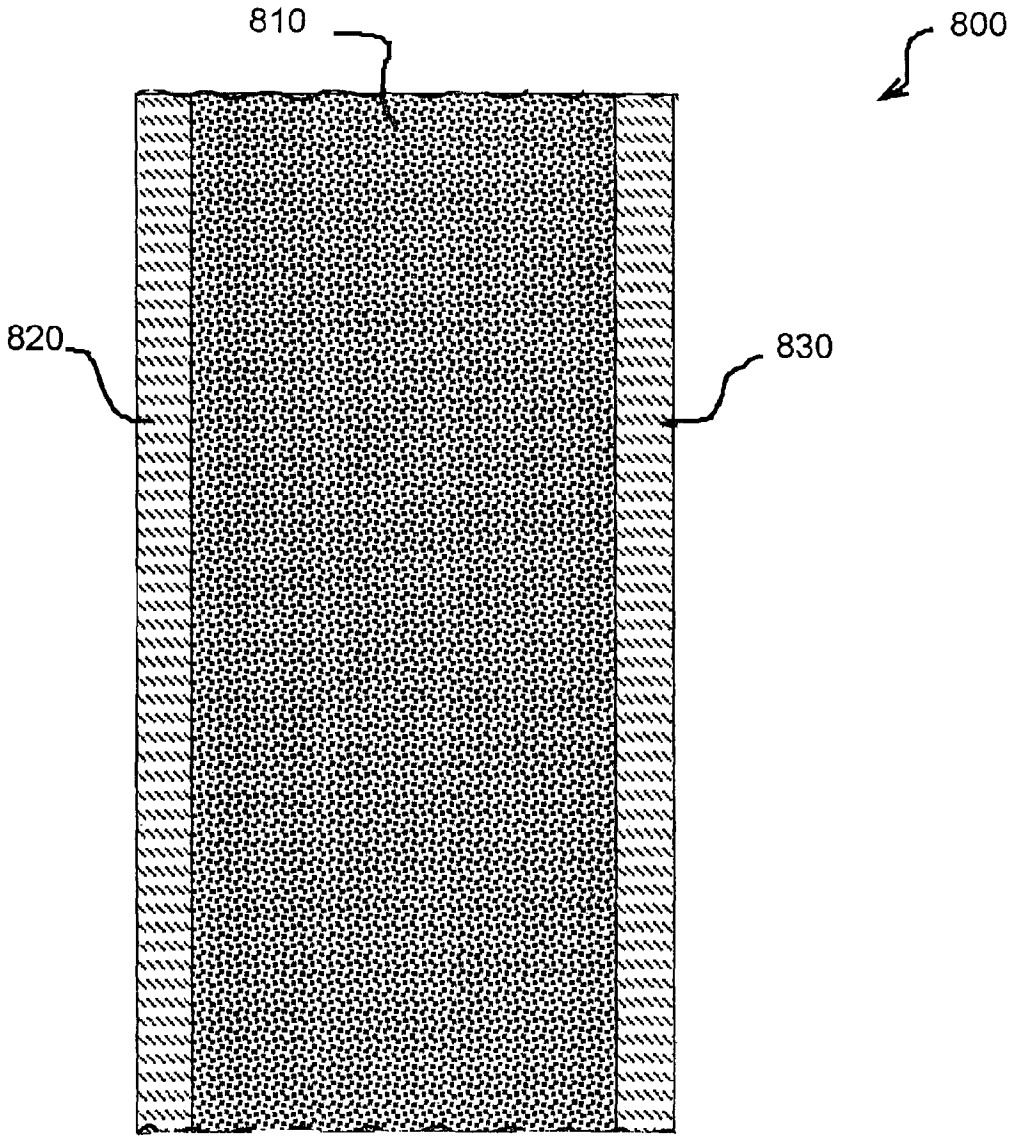
FIG. 8 is an exemplary illustration of an embodiment of a fibrous-material panel used to form a side of the passive thermal management system of FIG. 7, in accordance with various aspects of the present invention.

FIG. 8 is an exemplary illustration of an embodiment of a fibrous-material panel 800 used to form a side of the passive thermal management system 100 of FIG. 7, in accordance with various aspects of the present invention. The fibrous-material panel 800 comprises a layer of absorbing fibrous material 810 between two layers of liquid barrier material 820 and 830.

In accordance with an embodiment of the present invention, the absorbing fibrous material layer 810 is able to absorb PCM, due to the porous nature of the layer 810. Many paraffin-type PCMs have a crystalline structure, which can be physically absorbed or imbedded into fibrous materials. Again, the barrier layers 820 and 830 are used to contain the PCM (i.e., keep the PCM from leaking out of the interior of the panel 800). The fibrous material of the panel 800 may be any suitable PCM-absorbing material.

Figure 9:
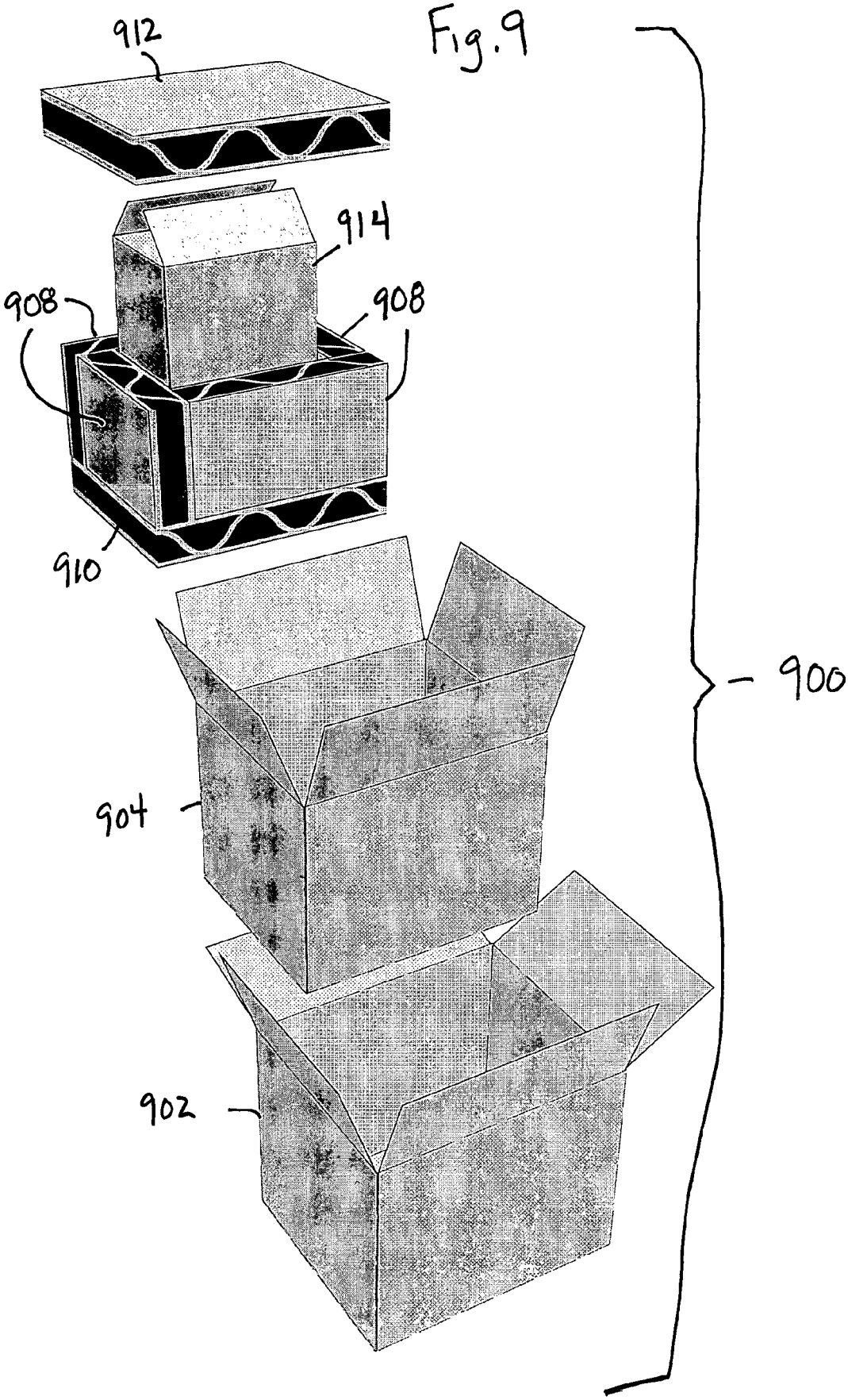
FIG. 9 is an alternate embodiment of the thermal management system according to the invention.

In accordance with a further embodiment of the present invention, FIG. 9 shows a container system 900 for transporting pharmaceuticals while maintaining the contents within a given temperature range for a sufficient time during transport. The container 900 includes a first outer enclosure member 902, and a second outer enclosure member 904. The outer enclosures 902 and 904 may be two flute B & C corrugated, providing a double layer thereof on the exterior. The enclosures may have closable top panels. The member 902 and 904 may include heat reflective or thermal insulation materials if desired. Further, as is noted in FIG. 9, the member 904 fits within member 902, providing insulation characteristics in conjunction with one another. Within the outer members 902 and 904, a series of PCM panels, including side panels 908, and top and bottom panels 910 and 912, form an enclosed space in conjunction with one another. The panels 908, 910 and 912 may be similar to that shown and described in prior embodiments, having a PCM material provided therein. As an example, the panels 908, 910 and 912 may be four inch expanded polystyrene having 2.4 gallons of PCM material, such as a Honeywell Astor Astorphase 8X-B paraffin material. The payload or contents of the container system 900 may be positioned within an internal enclosure member 914, which can be easily placed in and removed from the system 900 for handling, and provides another layer of corrugated around the payload area. As merely an example, the payload area provided by the system 900 may be 15.25"×11"×10", but any desired size may be configured.

Figure 10:
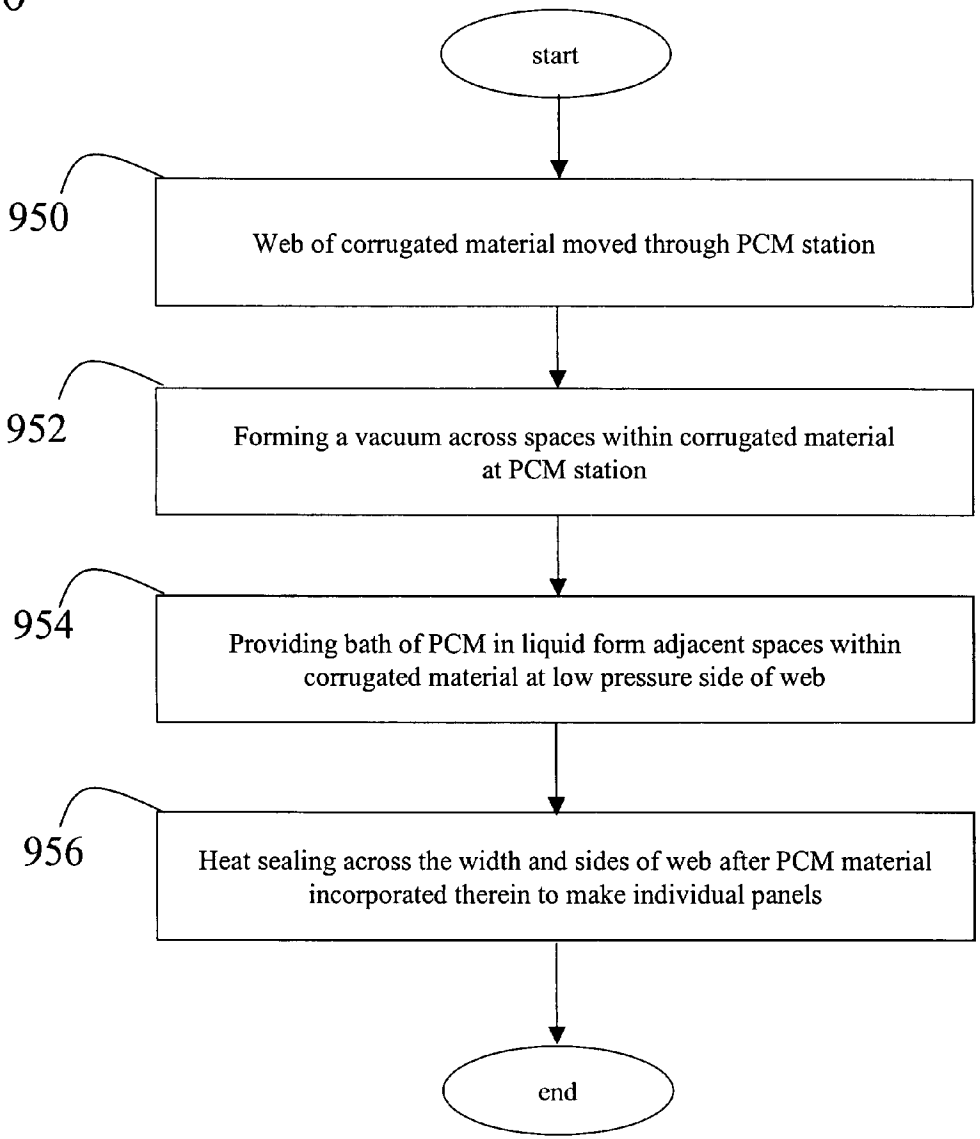
FIG. 10 is a flow chart of an embodiment of a method of making a PCM panel in accordance with an embodiment of the invention.

Turning to FIG. 10, a method of making a PCM panel in accordance with an embodiment of the invention is shown. In this method, a corrugated material is provided as a web in step 950, which can be moved through a PCM integration station at high speed. The PCM integration station is positioned adjacent the web as it moves, and forms a vacuum between the first and second sides of the web, and throughout the space created by the corrugations formed therein at 952. A bath of PCM material in liquid form is disposed adjacent a first side or low-pressure side of the web at 954. In this manner, PCM material is drawn into the space between corrugations by means of the vacuum, as the web moves through the PCM bath. Thus, as the web moves through the PCM station, the PCM material is incorporated into the web in a desired amount dependent on the vacuum applied and other variables. If desired, heat-sealing across the width and sides of the web at 956, to form the edges of individual panels, may form panels of a desired size. The PCM material is retained within the panel upon sealing, and individual panels can then be die cut or otherwise separated from the web. Any desired PCM panel size may be formed in a fast, cost-efficient manner.

Figure 11:
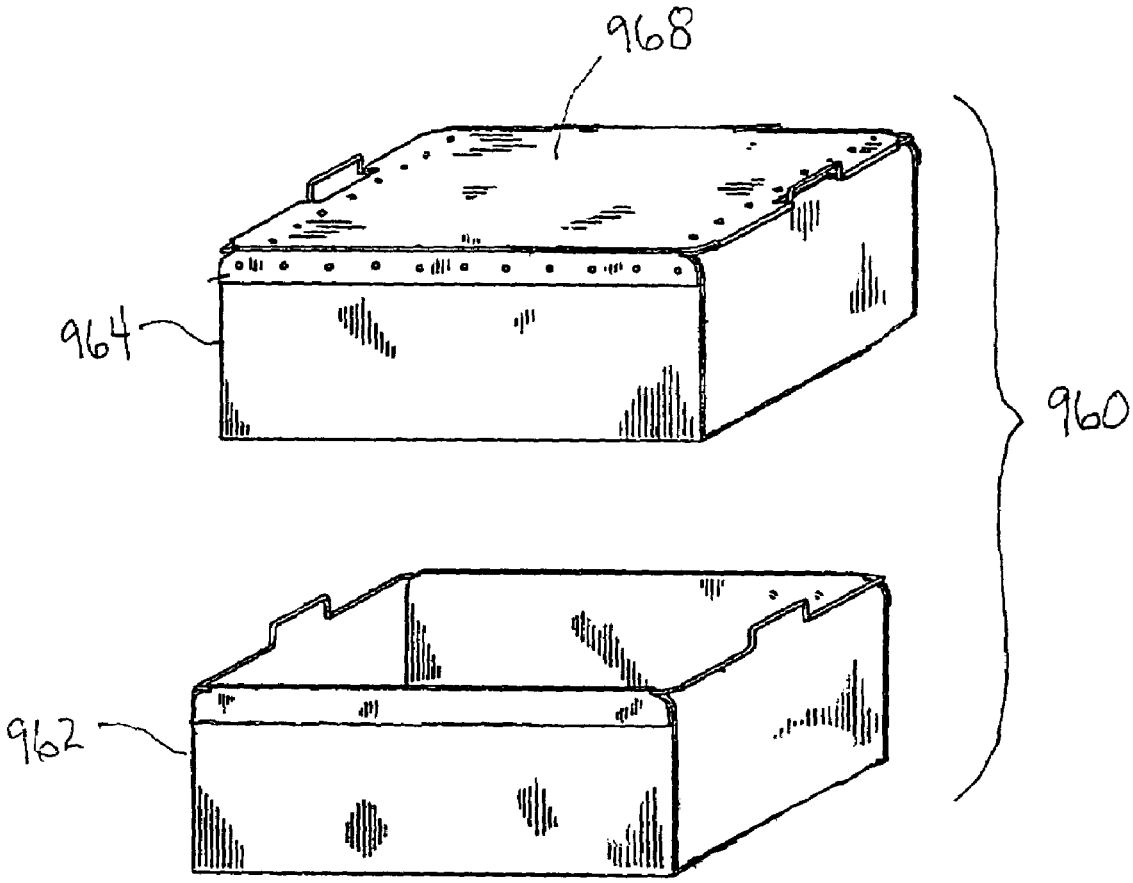
FIG. 11 is an alternate embodiment of the thermal management system according to the invention.

Turning to FIG. 11, a further embodiment of the thermal management system according to the invention is shown. The container system 960 for transporting temperature sensitive materials, provides a controlled environment which maintains the contents within a given temperature range for a desired time during transport. The container 960 may comprise a plurality of nested containers, depending on the temperature control characteristics desired, such as a first outer enclosure member 962, and at least one inner enclosure member 964. The enclosure 962 and 964 may be comprised of a plastic corrugated material, and may have an integral or separate closable top panel 968. Containers formed from corrugated plastic may be desirable because of their strength, durability, and resistance to moisture, chemicals, dirt, and the like. Each of the members 962 and 964 may be formed of a single panel or overlapping panels, depending on strength and thermal conditioning desired. The member 962 may include heat reflective or thermal insulation materials on the inner or outer surfaces if desired. The member 964 fits within member 962, providing insulation characteristics in conjunction with one another. Within the one or both of members 962 and 964, a PCM material may be incorporated into the space created by the corrugations, similar to previous embodiments, with the outer surfaces of the panels forming a PCM barrier. The members 962 and 964 form an enclosed space in a payload may be positioned as in prior embodiments. The PCM material may be incorporated into the panels of members 962 and 964 in a manner similar to that previously described. Further, to facilitate maintaining the position of the PCM material within the panels, flow restricting members may be formed in the corrugated areas of the panels, inhibiting the flow of the PCM material if in a liquid form. As the panels forming members 962 and 964 may be formed of a plastic corrugated material, the material may be folded upon itself to make plural layers of corrugation, to allow more PCM material to be incorporated. Additionally, the panels forming members 962 and 964 may be formed from a continuous pre cut and scored blank that is folded into the desired configuration via scored hinges formed between panels in a known manner. It may be desirable to provide hinges which include some corrugation space for the integration of PCM material at the hinge locations, so as to minimize any thermal loss/gain at these seams. Alternatively, a plastic material may be formed into a cylindrical form, with one or more additional cylinders nested within an outside cylinder, and PCM material positioned and retained between the cylinders.

In such thermal management systems as shown in FIGS. 1, 7, 9 and 11, thermal insulation and/or vacuum panels may not need to be used to, for example, to surround the PCM panels. At the same time, dependent on the design and use of the thermal management system 100, 700, 900 or 960, thermal insulation may provide cost savings to reduce the amount of PCM used in the system. Further, a thermal barrier such as a metallic reflective film could be incorporated onto the exterior surface of the systems or individual panels thereof, in accordance with various embodiments of the present invention. Mylar or aluminum foil could be used as the reflective film, for example. The film would serve to reflect radiation from a source of heat away from the container.

In summary, certain embodiments of the present invention comprise thermal management systems using corrugated materials, porous materials, or fibrous materials along with phase change materials and barrier materials to form containers. Temperature sensitive materials such as pharmaceutical products are placed into these containers such that a temperature of the temperature sensitive materials is maintained within a predefined temperature range over a predefined period of time.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A thermal management system, said system comprising:

a plurality of corrugated panels connected together to form a container;

a phase change material occupying voids within an interior of said plurality of corrugated panels; and a liquid barrier material provided on at least one surface of each of said plurality of corrugated panels to at least prevent said phase change material from migrating out of said interior of said plurality of corrugated panels.

2. The thermal management system of claim 1 wherein at least two of said plurality of corrugated panels are stacked to form one side of said container.

3. The thermal management system of claim 1 wherein said plurality of corrugated panels are selected from the group consisting of cardboard corrugated panels, plastic corrugated panels or combinations thereof.

4. The thermal management system of claim 1 wherein said phase change material comprises a paraffin material having a predetermined solid-to-liquid transition temperature.

5. The thermal management system of claim 1 wherein said phase change material comprises a eutectic salt solution having a predetermined solid-to-liquid transition temperature.

6. The thermal management system of claim 1 wherein said liquid barrier causes said phase change material to wick towards said liquid barrier when said phase change material is in a liquid phase.

7. The thermal management system of claim 1 further comprising a thermal barrier material coated onto an outside surface of said container.

8. The thermal management system of claim 1 further comprising a thermal barrier material surrounding an outside surface of said container.

9. The thermal management system of claim 1 further comprising a trigger agent within said phase change material to stimulate said phase change material to change phase at a predetermined temperature.

10. The thermal management system of claim 1 wherein a temperature of a pharmaceutical put into said container is passively maintained within a predetermined temperature range for a predetermined period of time by said container.

11. The thermal management system of claim 2 further comprising a thermal barrier being between said at least two stacked corrugated panels.

12. A method of manufacturing a thermal management system, said method comprising:

depositing a liquid barrier material onto at least one surface of each of a plurality of corrugated panels;

injecting a liquid-phase mixture of phase change material and trigger agent into a plurality of voids within said plurality of corrugated panels;

sealing said mixture of phase change material and trigger agent within said plurality of corrugated panels; and connecting said plurality of corrugated panels to form a container.

13. The method of claim 12 further comprising depositing a thermal barrier material onto an outside surface of said container.

14. A method of using a thermal management system, said method comprising:

preconditioning a container at a preconditioning temperature for a predefined period of time, said container being designed to comprise a plurality of corrugated panels connected together to form said container, a phase change material occupying voids within an interior of said plurality of corrugated panels, and a liquid barrier material deposited onto at least one surface of each of said plurality of corrugated panels to at least prevent said phase change material from leaking out of said interior of said plurality of corrugated panels;

opening said container;

placing at least one temperature sensitive material sample into said container;

closing said container; and shipping said container to a destination location during a predetermined time period such that a temperature of said at least one sample stays within a predetermined temperature range over said predetermined time period due to said design of said container.

15. A thermal management system, said system comprising:

a plurality of structurally porous panels connected together to form a container;

a phase change material occupying voids within an interior of said plurality of structurally porous panels; and a liquid barrier material deposited onto at least one surface of each of said plurality of structurally porous panels to at least prevent said phase change material from leaking out of said interior of said plurality of structurally porous panels.

16. A thermal management system, said system comprising:

a plurality of fibrous-material panels connected together to form a container;

a phase change material absorbed into an interior of said plurality of fibrous-material panels; and a liquid barrier material deposited onto at least one surface of each of said plurality of fibrous-material panels to at least prevent said phase change material from leaking out of said interior of said plurality of fibrous-material panels.

* * * * *